US005658067A

United States Patent [19]

Engle et al.

[11] Patent Number: 5,658,067

[45] Date of Patent: Aug. 19, 1997

[54] MODULAR LIGHT UNIT

[75] Inventors: Joseph D. Engle, Naperville; John R. Howard, West Chicago; Robert Machacek, Lombard, all of Ill.; George S. Boznos, Westchester, Ohio

[73] Assignee: Munters Corporation, Ft. Myers, Fla.

[21] Appl. No.: 516,208

[22] Filed: Aug. 17, 1995

Related U.S. Application Data

[63] Continuation of Ser. No. 353,902, Dec. 12, 1994, abandoned.

[51] Int. Cl.[6] ..... F21V 23/06

[52] U.S. Cl. ..... 362/222; 362/219; 362/225; 439/235

[58] Field of Search ..... 362/219, 222, 362/223, 225, 374, 217, 221, 226; 439/115, 119, 226, 228, 235

[56] References Cited

U.S. PATENT DOCUMENTS

| | | | |
|---|---|---|---|
| 3,428,799 | 2/1969 | Bassani | 362/219 |
| 3,464,727 | 9/1969 | Pascucci | 362/374 |
| 4,639,841 | 1/1987 | Salestrom et al. | 362/227 |
| 4,726,781 | 2/1988 | Bernhart et al. | 362/219 |
| 5,113,328 | 5/1992 | Foster et al. | 362/223 |
| 5,124,896 | 6/1992 | Bentley | 362/223 |
| 5,226,724 | 7/1993 | Kanarek | 362/219 |

*Primary Examiner*—Alan Cariaso

*Attorney, Agent, or Firm*—Fitzpatrick, Cella, Harper & Scinto

[57] ABSTRACT

A modular light unit is disclosed which has a housing including an openable access panel with an electric lamp mounted in the housing. The housing has opposed ends which respectively mount male and female double insulated electrical connector plug means therein for electrically connecting the light unit to another light unit. The double insulated connector is formed with fully isolated terminals.

29 Claims, 10 Drawing Sheets

MODULAR LIGHT UNIT

This application is a continuation of Application Ser. No. 08/353,902, filed Dec. 12, 1994 now abandoned.

FIELD OF THE INVENTION

The present invention relates to modular light units and more in particular to a so called under cabinet light system in which a plurality of individual light modules can be electrically connected directly to each other through double insulated electrical plugs mounted in their ends.

BACKGROUND OF THE INVENTION

Under cabinet lighting has previously been provided by a variety of manufactures. Such lighting units typically consist 0f relatively thin fixtures hard wired together and to a source of electrical current. That is, they are typically directly wired to the electrical current supply in a home, building or the like through conventional wiring arrangements. Such systems require installation services of a licensed electrician and are time consuming and relatively expensive to install.

While some attempts have been made to reduce the amount of labor for the installation processes of conventional under cabinet light systems, such attempts have not been entirely satisfactory. For example, Salestrom et al. in U.S. Pat. No. 4,639,841, disclose a modular lighting system in which under cabinet type lighting is provided in small individual modular units that plug directly to one another. However, these units use exposed bulbs and, more importantly, use exposed electrical plugs at their ends. These, therefore, represent an electrical hazard to the user and installer. They can not be installed, removed or rearranged with the units connected to the power supply.

Accordingly, it is an object of the present invention to provide a modular lighting system which is simple in construction and which can be easily installed even by unskilled workers.

Another object of the present invention is to provide a lighting system in which a plurality of light modules can be connected together safely in end to end relationship in order to provide varying lengths for the overall lighting arrangement.

Another object of the present invention is to provide a modular lighting system which allows use of both fluorescent and halogen light fixtures in the same system.

Yet another object of the present invention is to provide a modular lighting system which is relatively simply to install.

A still further object of the present invention is to provide a modular under cabinet lighting system which is relatively simple to manufacture, easy to service, and to install.

SUMMARY OF THE INVENTION

A modular light unit constructed in accordance with the present invention includes an elongated generally L-shaped in cross section housing. An elongated generally L-shaped in cross section access panel is pivotally connected at the end of one of its legs to the end of one of the legs of the housing such that in a closed position the legs of the housing and the access panel are generally parallel to each other and thereby define a wire-way within the unit. The longer leg of the L-shaped housing is longer than the parallel leg of the access panel whereby a portion of the housing extends beyond the access panel and defines an enclosure area for an electric lamp, e.g., a fluorescent light tube or a series of halogen bulbs. A removable cover is provided for the enclosure area which in one embodiment is translucent for use with a fluorescent bulb, and in another embodiment is non-transparent and has mounting openings therein for receiving halogen light bulb units. Any transformers, ballasts and electrically wiring for the lamps used with the unit are contained in the wire way.

The opposite ends of the module have male and female double insulated electrical plug means having fully isolated terminals therein for electrically connecting the unit to another corresponding light unit without requiring a hard wiring connection and without using exposed electrical contacts.

The above and other objects, features and advantages of this invention will be apparent from the following detailed description of illustrative embodiments thereof, which description is to be read in connection with the accompanying drawings wherein:

DESCRIPTION OF THE PREFERRED EMBODIMENT

Figure 1:
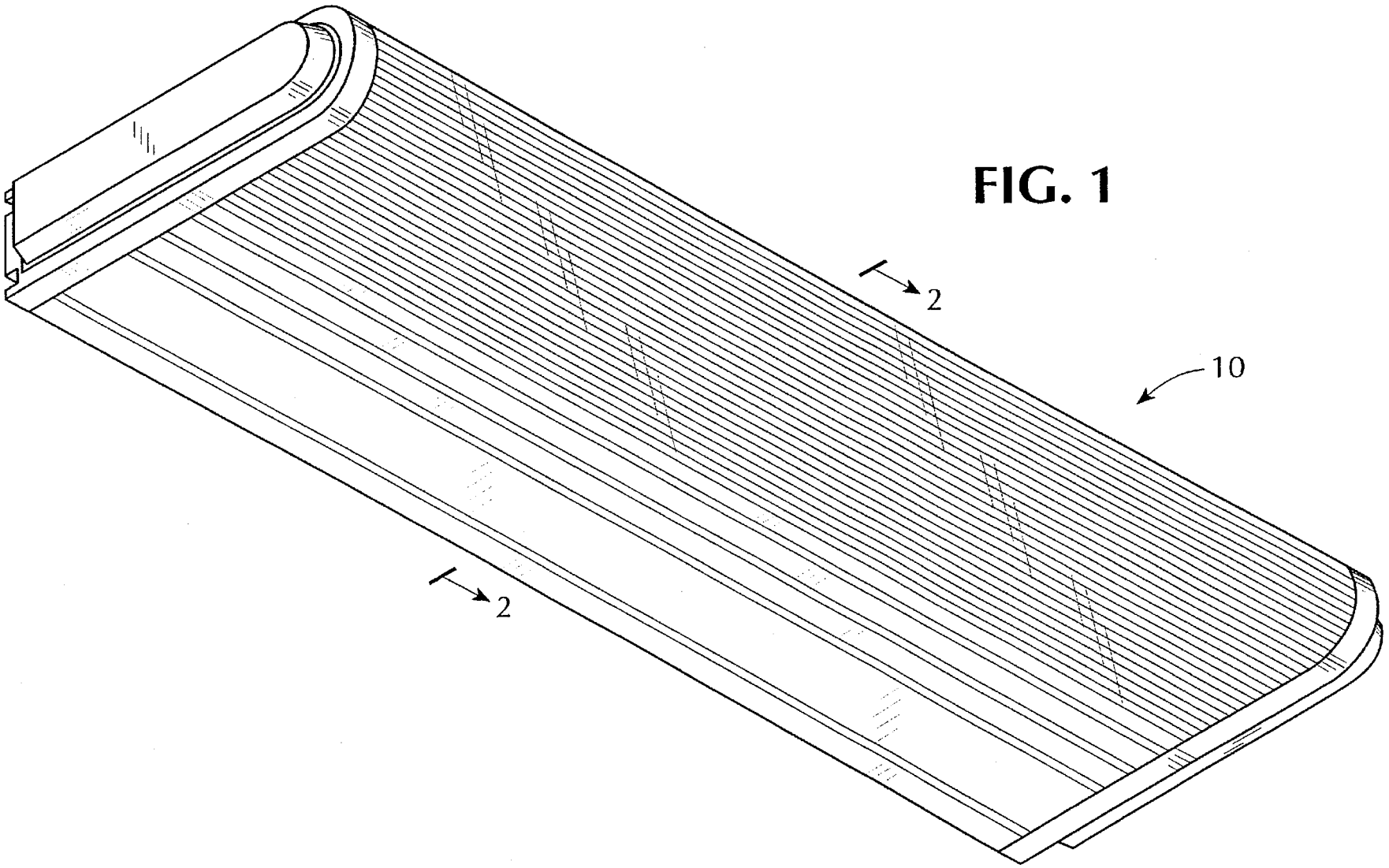
FIG. 1 is a perspective view of a modular lighting unit constructed in accordance with the present invention.
Figure 2:
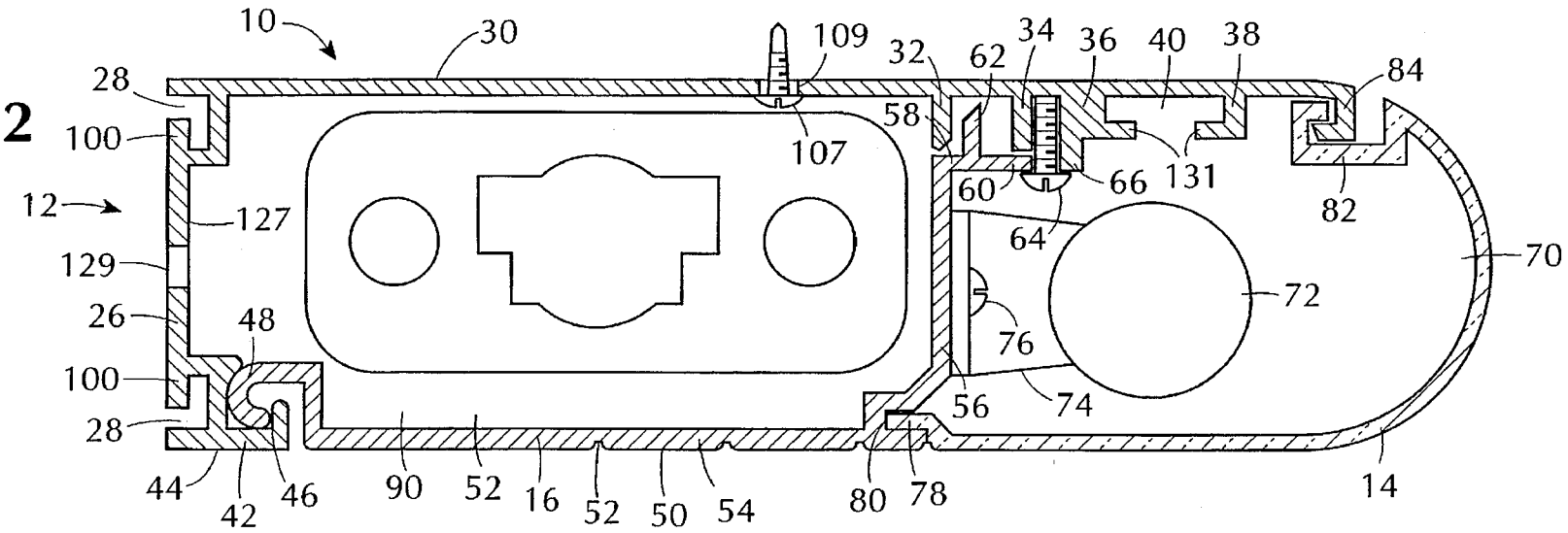
FIG. 2 is a sectional view of the modular light unit shown in FIG. 1, taken along line 2—2 of FIG. 1.

Referring now to the drawings in detail, and initially to FIG. 1, a modular light unit 10 constructed in accordance with the present invention is illustrated. The light unit includes a housing 12 which is generally L-shaped in cross section, as seen in FIG. 2, and contains one or more electric lamps or bulbs 72 in a portion of the housing which is inclosed by a transparent cover 14. The module further includes an access cover or panel 16, which is also generally L-shaped in cross section, as seen in FIG. 2.

Figure 18:
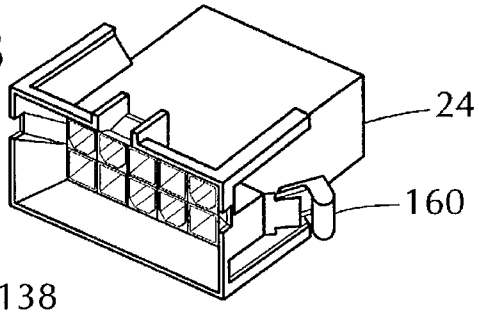
FIG. 18 is a perspective view of a female double insulated connector used in accordance with the present invention.
Figure 17:
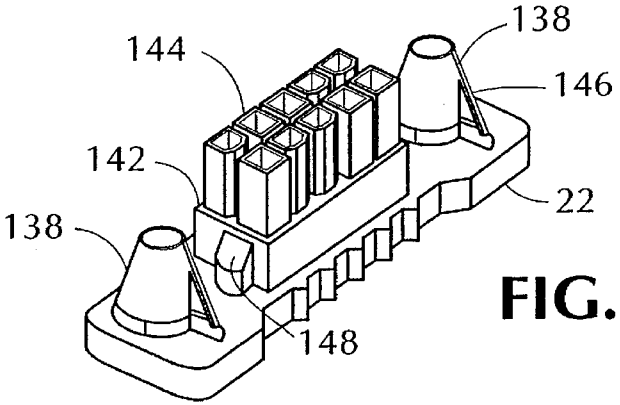
FIG. 17 is a perspective view of a male double insulated connector used in the present invention.

The opposed ends of light unit 10 are closed by separate end caps 18, 20, which are preferably formed of an electrically insulating material such as Lexan®. The end caps, as described in detail hereinafter, provide mounting openings for double insulated electrical connector members which have fully isolated terminals. The end caps mount the connectors in a predetermined relationship so that two or more modules 10 can be electrically interconnected by simply sliding the ends of the units together. Cap 18 has a male connector 22 (FIG. 17) mounted therein and cap 20 has a female connector 24 (FIG. 18) mounted therein.

The construction of the housing arrangement for light unit 10 is shown in greater detail in FIG. 2. As seen therein housing 12 is generally L-shaped, and is formed of extruded aluminum. The housing includes a short rear leg or face 26 which has a pair of L-shaped grooves 28 formed therein. The upper mounting leg or surface 30 of housing 12 has a greater length than leg 26. It has a generally flat exterior surface and is adapted to be mounted against the under surface of an overhead cabinet or %he like to which the light module is to be secured. The inner surface of leg 30 includes a plurality of extruded ribs 32, 34, 36 and 38 therein. Ribs 36, 38 have an undercut groove or channel 40 defined between them. This channel aids in mounting the end caps to the housing, as described hereinafter.

The rear or vertical leg 26 of housing 12 includes an extension 42 on its free end 44. This extension has an inwardly opening channel 46 formed therein. Channel 46 cooperates with the curved or hooked end portion 48 of L-shaped access cover or panel 16, which may also be formed of extruded aluminum. The hooked end 48 of the cover panel provides a pivotal connection with a channel 46 so that the access panel can be pivoted towards and away from its closed position.

Panel 16 has an exterior decorative surface 50, having a plurality of grooves 52 or the like formed therein. The long leg 54 of cover 16 is positioned to be generally parallel to leg 30 of housing 12. Its short leg 56 extends generally perpendicular to leg 54 and is located in the closed position of the cover to be parallel to leg 26 of housing 12. The free end 58 of panel 16 has a flange 60 formed therein which also extends parallel to the leg 30 of housing 12 in the closed position of the access cover. The flange 60 has an elongated leg 62, which in the closed position of the access panel, is located between ribs 32, 34, of housing leg 30. This cooperation between ribs 32, 34 and leg 62 serves as a guide arrangement for proper alignment of the panel relatively to the housing. The access panel is held in its closed position by one or more self tapping screws 64 which are engaged in slots 66 formed in the edge of flange 60 and threaded between ribs 36, 34.

The area beneath the portion of housing leg 30 which extends beyond leg 56 of access panel 16 defines a lamp enclosure area 70 in which a fluorescent lamp or bulb 72 or the like is mounted. The bulb is secured between mounting terminals 74 at its opposite ends (only one of which is seen in FIG. 2) which in turn are connected to leg 56 of access panel 16 by screws 76 or the like. The enclosure area 70 is completed by the transparent cover 14.

As seen in FIG. 2, cover 14 has a free end 78 which is engaged in a channel 80 formed at the juncture of legs of 54 and 56 of access panel 16. The opposite end 82 of cover 14 has a hook shaped construction which is adapted to snap fit in a complimentary hook shaped channel 84 formed in the free end of housing leg 30. Because cover 14 is formed of resilient translucent material, it can snap into place for simple removal by the user in order to replace bulb 72 when necessary. When the cover is removed, no electrical wiring is exposed to the user because the configuration of housing 12 and cover plate 16 defines a wire way 90 which contains all of the electrical wiring and ballasts or transformers required for lamp 72.

Figure 11:
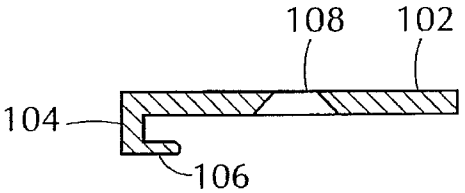
FIG. 11 is a sectional view taken along line 11—11 of FIG. 10.
Figure 10:
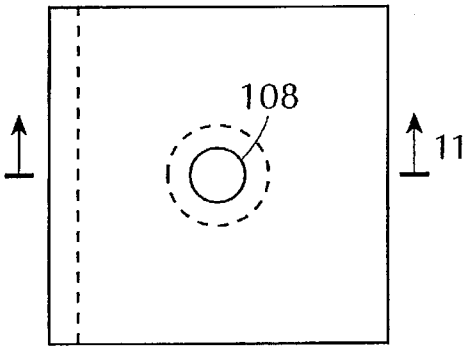
FIG. 10 is a plan view of another mounting bracket for use with the present invention.
Figure 9:
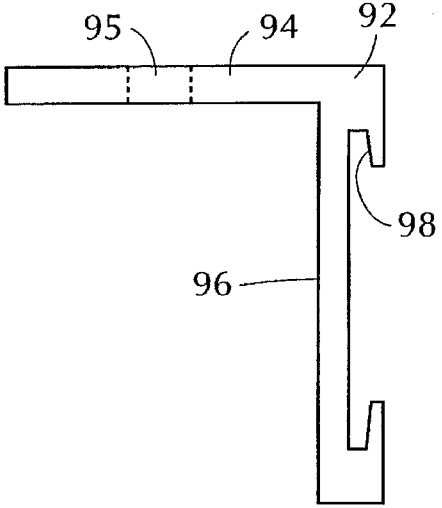
FIG. 9 is an elevational view of a mounting bracket for use with the light fixture of the present invention.
Figure 13:
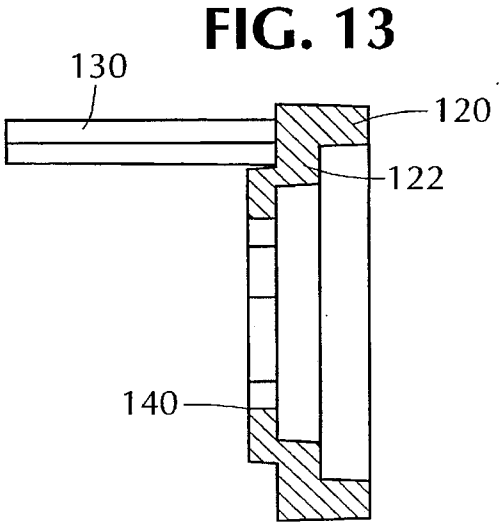
FIG. 13 is a sectional view taken along line 13—13 of FIG. 5.
Figure 15:
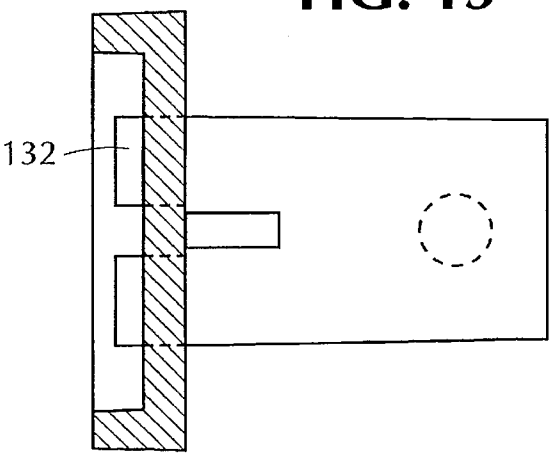
FIG. 15 is a sectional view taken along line 15—15 of FIG. 6.
Figure 12:
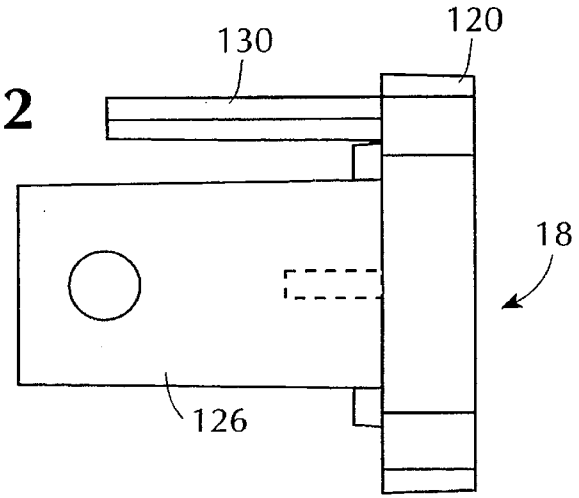
FIG. 12 is an end view of the end cap shown in FIG. 5 taken along line 12—12 of FIG. 5.
Figure 14:
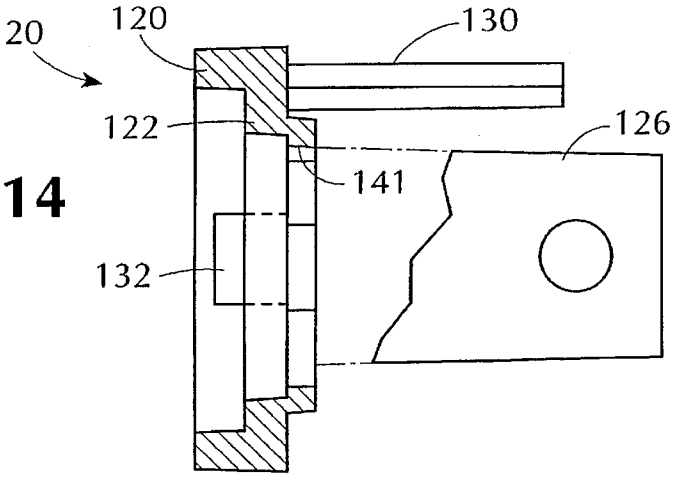
FIG. 14 is a partial sectional view taken along line 14—14 of FIG. 6.
Figure 16:
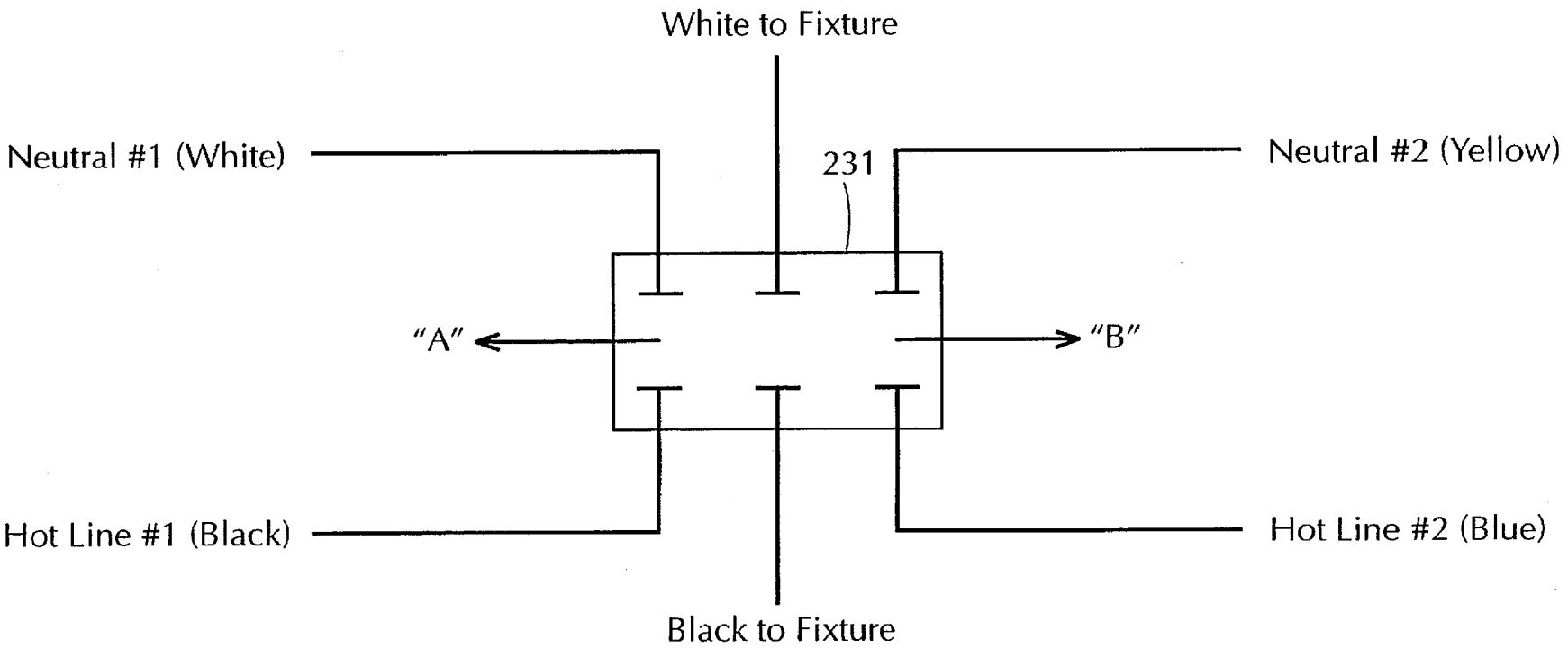
FIG. 16 is a schematic electrical diagram for a circuit use in accordance with the present invention to separately and simultaneously control two light fixtures in the modular light unit.

Modular light unit 10 can be mounted to the bottom of a cabinet in any convenient manner. Two alternatives are illustrated in FIGS. 9–11. In one alternative, an L-shaped bracket 92 having a flat leg 94 can be screwed to an under surface of a cabinet in any convenient manner through bores 95 formed therein. The other leg 96 has an undercut channel 98 formed therein which is adapted to receive the ends 100 of the section of the rear housing leg 26. between grooves 28. This arrangement allows the modular lighting unit to slide in the under cut channel 98.

Another preferred mounting arrangement is shown in FIGS. 10 and 11. In this arrangement an L-shaped bracket 102 is provided which has a short leg 104 and a flange 106 formed thereon. Plate 103 is secured to the under surface of a cabinet Or the like by one or more screws passing through an opening 108 formed therein. In this embodiment flange 106 is adapted to be received in upper groove 28 of housing rear wall 26 and supports the modular light unit against the underside of the cabinet. Of course a plurality of such clips may be used depending on the size, length and weight of the module. These clips support the rear of the housing. In addition to these clips, the housing will be secured to the overhead cabinet by one or more screws 107 inserted through prepunched holes 109 in housing legs 30.

Because the module 10 is relatively light in weight, this simple arrangement will hold the unit in place while permitting its ease of removal. Both of the described mounting arrangements allow the light units to be slid laterally with respect to one another in order to make and break the electrical contacts by connectors 22, 24.

The mounting arrangements using the J-clips previously described, allow the units to be easily installed without opening the wire way. The clip 108 allows the fixture to be slid side ways to engage the double insulated connectors while maintaining the security of the mounting system.

Figure 3:
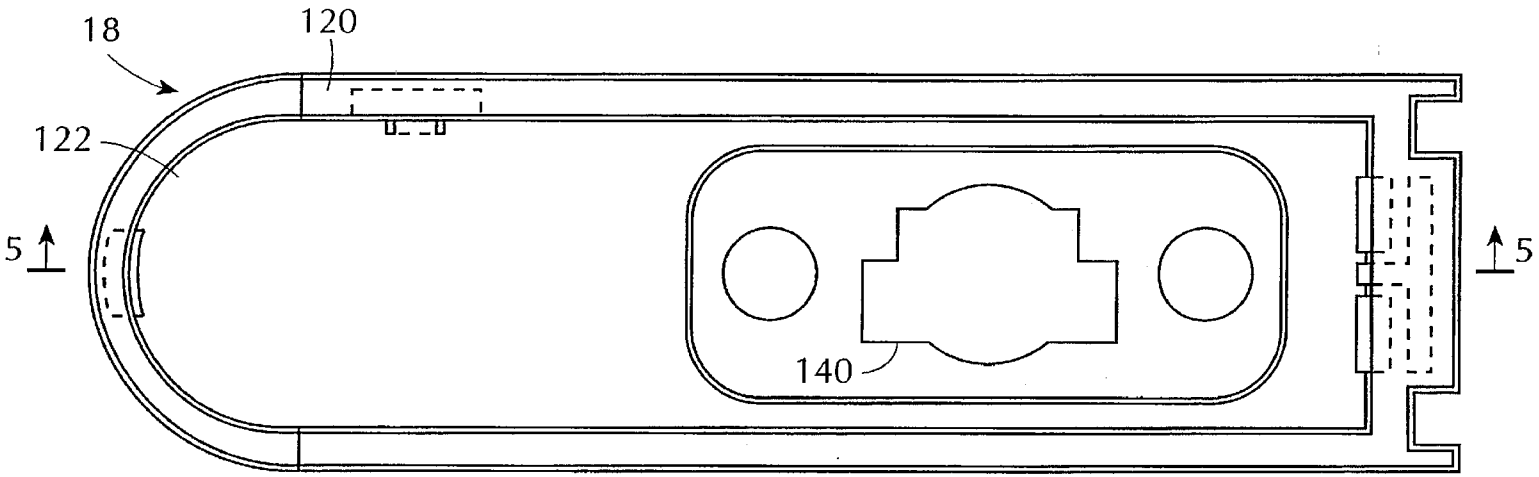
FIG. 3 is an elevational view of the outside face of the end cap at one end of the modular light unit.
Figure 4:
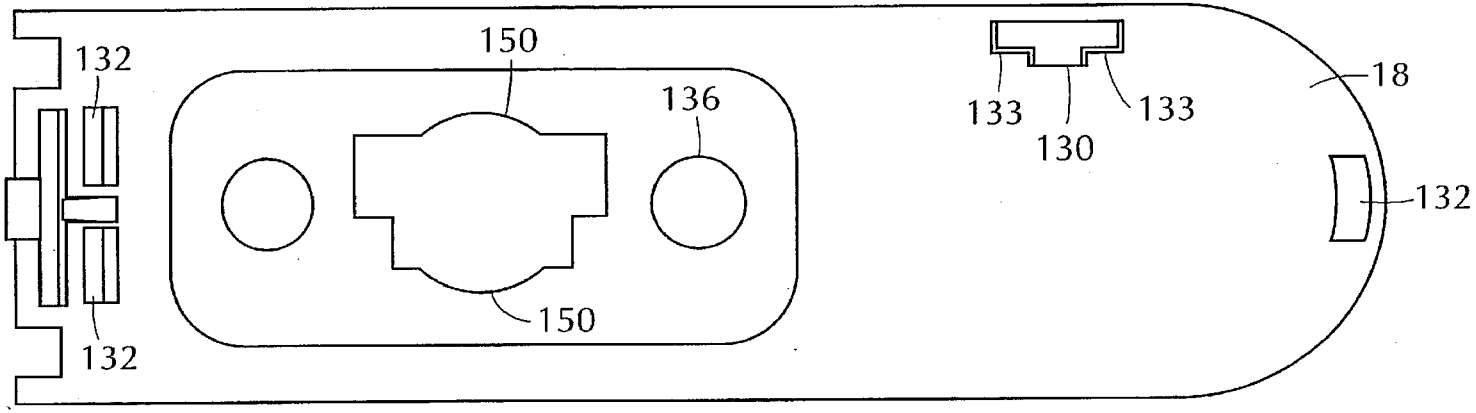
FIG. 4 is an elevational view of the inside face of that end cap, but inverted as compared to FIG. 3.

As described above, the ends of the modular unit 10 are closed by electrically insulated caps 18 and 20. Cap 18 is illustrated in detail in FIGS. 3–5. FIG. 4 shows the interior surface of the cap and FIG. 3 shows the exterior surface. It is noted that in FIG. 3 the cap has been inverted relative to its position shown in FIG. 4.

Figure 5:
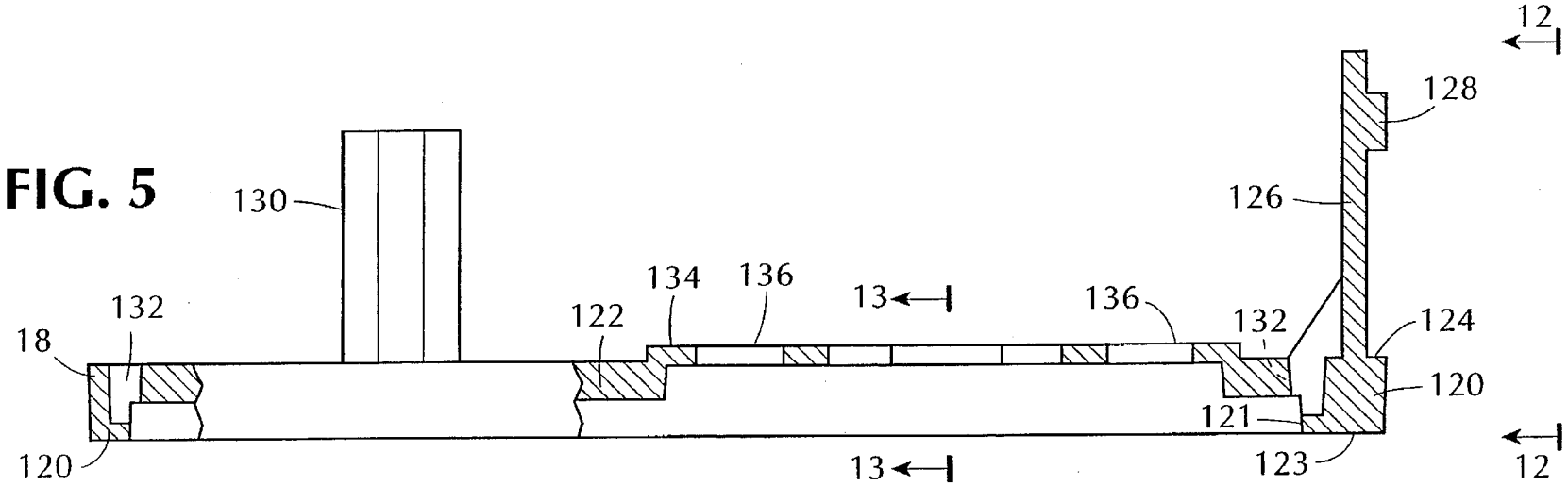
FIG. 5 is a partial sectional view taken along line 5—5 of FIG. 3.

As seen in FIGS. 3–5, cap.18 includes a peripheral rib 120 and a central planar area 122. Rib 120 is shaped to be complementary to the periphery of the cross section defined by the housing 12, access panel 16 and cover 14. The rear end 124 of cap 18 includes an elongated flexible tongue or tab 126 extending inwardly thereof. This tongue includes a locking button 128 extending outwardly therefrom. When installed, tongue 126 aligns under channel 127 formed in rear wall 26 of the housing 12 and locking button 128 snaps into position in a prepunched opening 129 in leg 26 to hold the cap in position. In addition, an alignment tongue 130 also extends inwardly from cap 18. This tongue is generally T-shaped in cross section and located to align with groove 40 of housing 12 and to be received therein. This tongue and the flexible tab 126 provide secure attachment for the cap to the housing.

Preferably, during the assembly process, after cap 18 is installed, the flanges 131 of channel 40 in housing leg 30 are "staked" or deformed to engage the legs 133 of tab 126 to resist removal thereof from the housing.

Cap 18 also has internal recesses 132 formed therein, as seen in FIGS. 3 and 4, which open to the interior edge 121 of rib 120. The openings provided by these recesses are engaged by tabs on a removable cover 70 as described hereinafter.

The central panel 122 of cap 18 includes a recessed connector mounting portion 134 in which the connector 22 is supported. This recessed portion 134 has a pair of openings 136 formed therein which are adapted to receive the mounting cones 138 of connector 22. (See FIG. 17). In addition it has a central recess 140 formed therein which is adapted to receive the main body portion 142 of the connector.

Connectors 22, 24 are of known construction and are sold by the Molex Company under the tradename MINIFIT-BMI (for blind mating interconnect). These modular connectors have been sold in the past for high current/high density applications requiring blind mating of modules, sub-assemblies or printed circuit boards. They provide blind mating of wire to wire and have fully isolated terminals. This means that the terminals (e.g. the terminals 144 on module 22) have their electrical conductors fully enclosed and not exposed to contact by the user.

Figure 23:
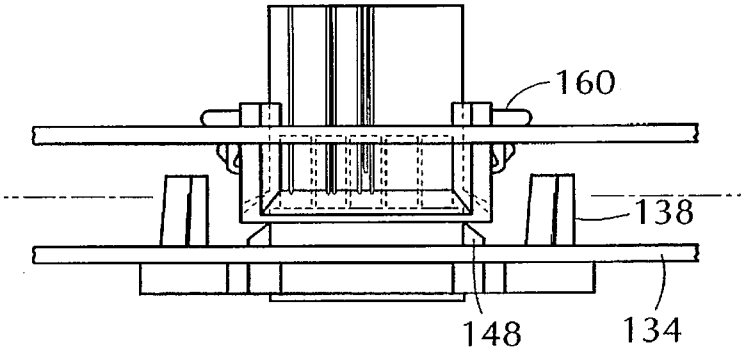
FIG. 23 is a plan view showing the connectors mounted in their respective covers and joined together.
Figure 22:
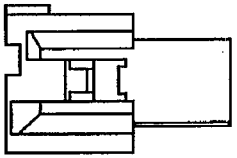
FIG. 22 is a side view of the connector shown in FIG. 18.
Figure 21:
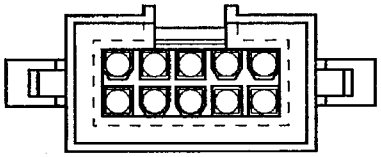
FIG. 21 is an elevational view of the connector shown in FIG. 18.
Figure 20:
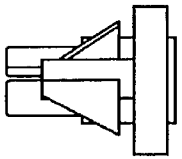
FIG. 20 is a side view of the connector shown in FIG. 17.
Figure 19:
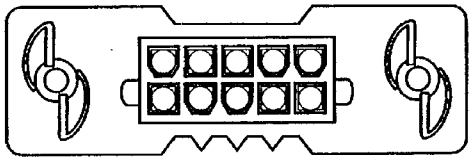
FIG. 19 is an elevational view of the connector shown in FIG. 17.

When module 22 is inserted such that its mounting cones 138 extend through the openings 136 and the terminal portions 144 extend through opening 140, the flanges 146 of the mounting cones and the snap tabs 148 of the terminal block 144 are located on the exterior face of the recessed plate 134, as seen in FIG. 23 to hold the connector in place. While the opening 140 is formed to be generally complimentary to the peripheral shape of the terminal block 144, it preferably includes arcuate sections 150. This construction provides the installer with a conventional circular shape electrical access opening for hard wiring of the electrical power supply to the module if desired. For example, the installer can remove the connector 22 from the panel wall 134 and position it within the wire way 90. He can then take conventional BX cable and secure it in the access opening 150 using conventional electrical wiring hardware, connect the end of the BX cable to a female connector module 24 and mate the male connector and the female connector in the wire way. This would typically be done with the first unit installed in a string of units. As a result, no additional hardware or inventory of modules needs to be carried by the contractor for the first unit in a line.

Figure 6:
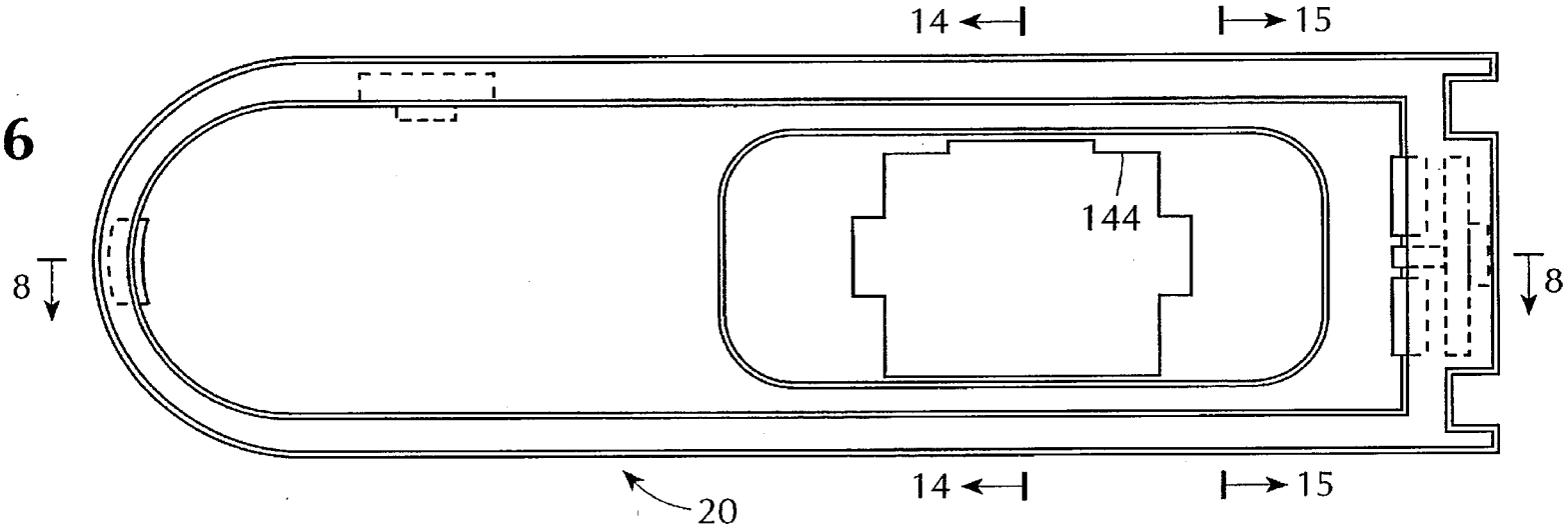
FIG. 6 is an end view the end outside face of the cap at the opposite end of the light module.
Figure 7:
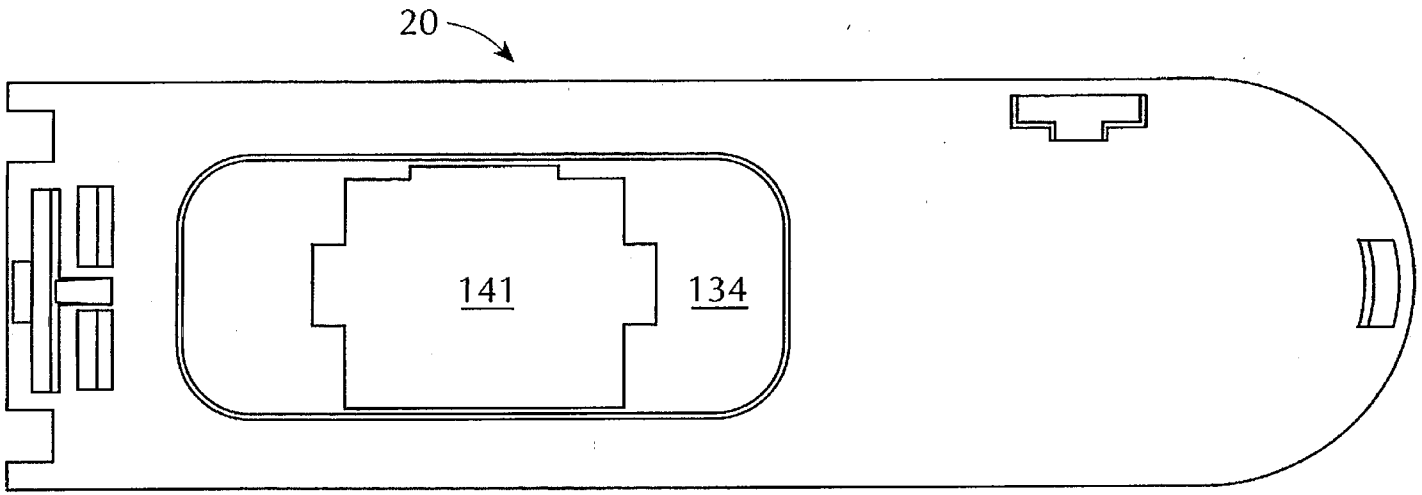
FIG. 7 ms an elevational view similar to FIG. 6 but showing the inside surface of that end cap.
Figure 8:
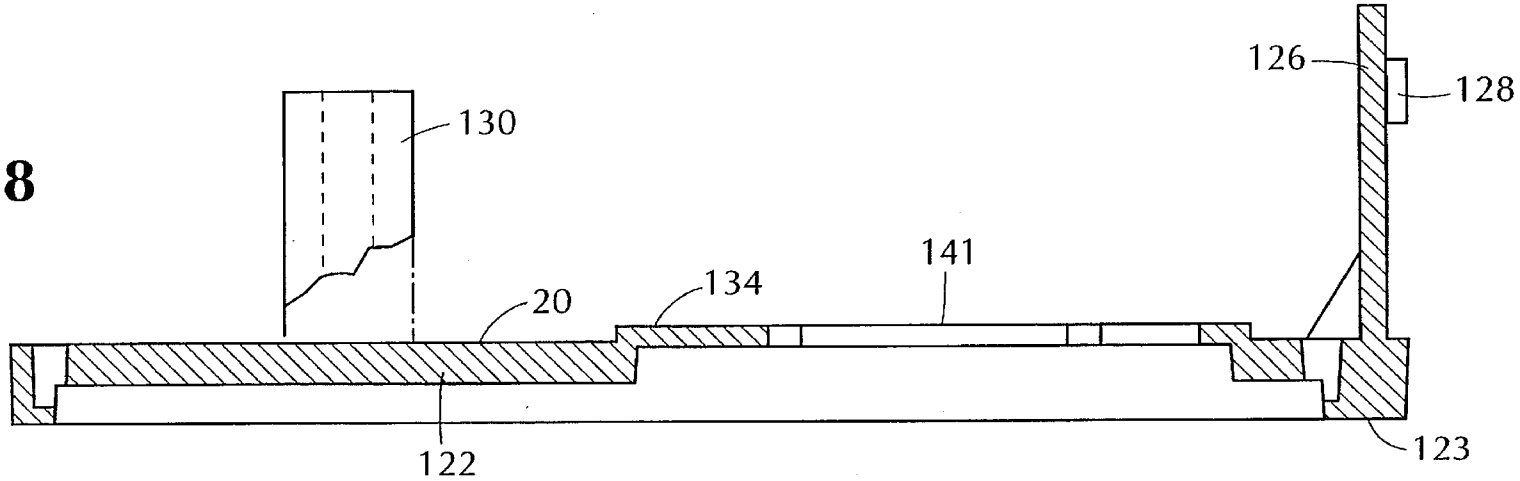
FIG. 8 is a sectional view taken along line 8—8 of FIG. 6.

The end cap 20 for the opposite end of the light module is illustrated in FIGS. 6–8. This end cap is similar in construction to end cap 18, and like parts have been identified with the same numerals. The essential difference between the end cap 20 and end cap 18 is that the recessed portion 134 has a somewhat differently shaped opening 141 formed therein. This opening is shaped to conform generally to the periphery of the female connector 24 shown in FIG. 18. This connector has snap tabs 150 on its opposite ends which allow the connector to be snapped into the opening, as seen in FIG. 23. As with cover 18, cover 20 has tongues 126, 130 which guide and snap it into position on the end of the housing.

As noted above, the recess portions 134 of the end caps are recessed from their respective central panels 122.

The depth of the recess for these panels is selected relative to the dimensions of connectors 22, 24 so that the connectors can make an electrical contact with each other when the faces 123 of the peripheral ribs 120 of covers 18, 20 abut one another. This provides an enclosure completely around the electrical contacts, concealing the same and protecting the user against any possible contact with electrical current. This provides a neat and trim appearance and avoids exposed wiring such as had been required with most previously proposed serial connected light modules.

As described above, the Lexan® injection molded end caps are mounted without fasteners. The simple stake and snap pin mounting arrangement speeds assembly and gives the outside of the product a neat and clean appearance.

Figure 24:
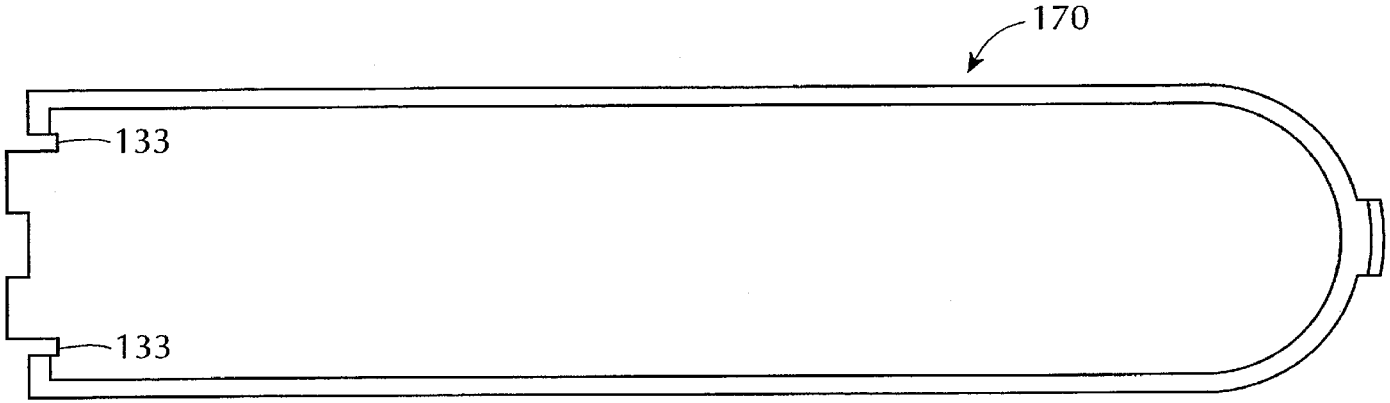
FIG. 24 is an elevational view of an end cap cover used in accordance with the present invention.
Figure 25:
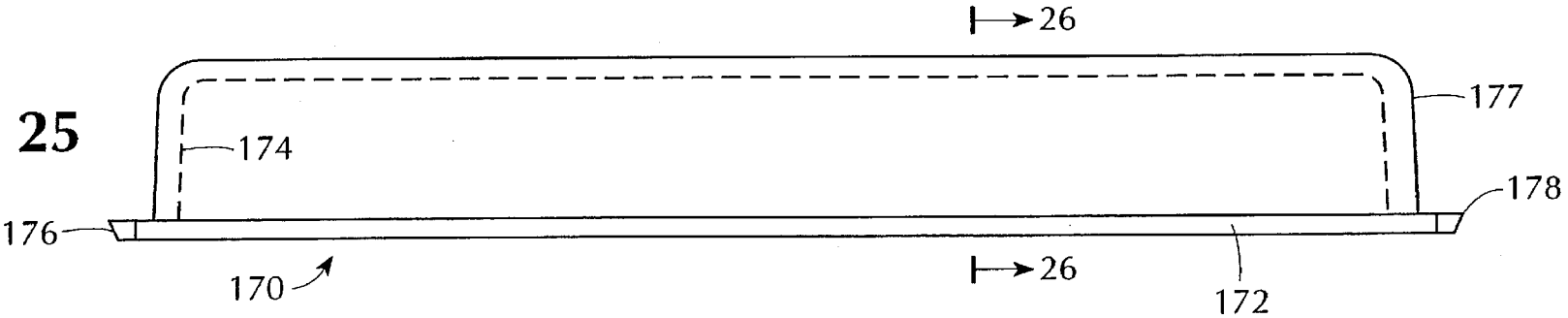
FIG. 25 is a plan view of the cover shown in FIG. 24.
Figure 26:
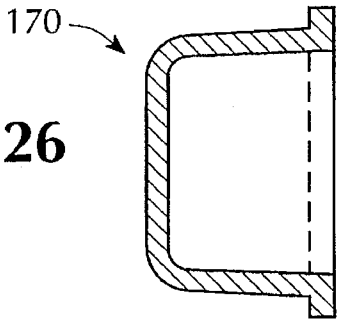
FIG. 26 is a sectional view taken along the line 2626 of FIG. 25.

In accordance with another aspect of the present invention, a removable end cap or cover 170 is provided for selectively closing off the end of a light module in a string of modules. That is, at the end of the string, where no further electrical connections are to be made, cover 170 can be snapped into place in order to cover and thus close the end of the panel and conceal the electrical connection module therein. The cover 170, as seen in FIGS. 24–26, has a peripheral configuration which is generally complimentary to the peripheral configuration of the light module and the associated end cap. It has a peripheral face 172 which is complimentary to the rib 120 of the end caps. The cap has a U-shaped configuration in cross section, as seen FIG. 26, in order to accommodate the connector it is to cover. Its rear end 174 has a pair of tabs 176 which are adapted to be received in the recesses or openings 132 which are found in the end caps. Also, a pair of parallel slots 133 are formed therein so that manual depression of rear end 174 will easily release the engagement of tabs 176 in recess openings 132 in the caps 18, 20. The front end 177 of cap 170 has a projecting tab 178 which is adapted to be received in the opening or recess 132 at the front curved wall of the end caps. Thus, the closure cap can be snap fit into and removed from the light module.

Figure 27:
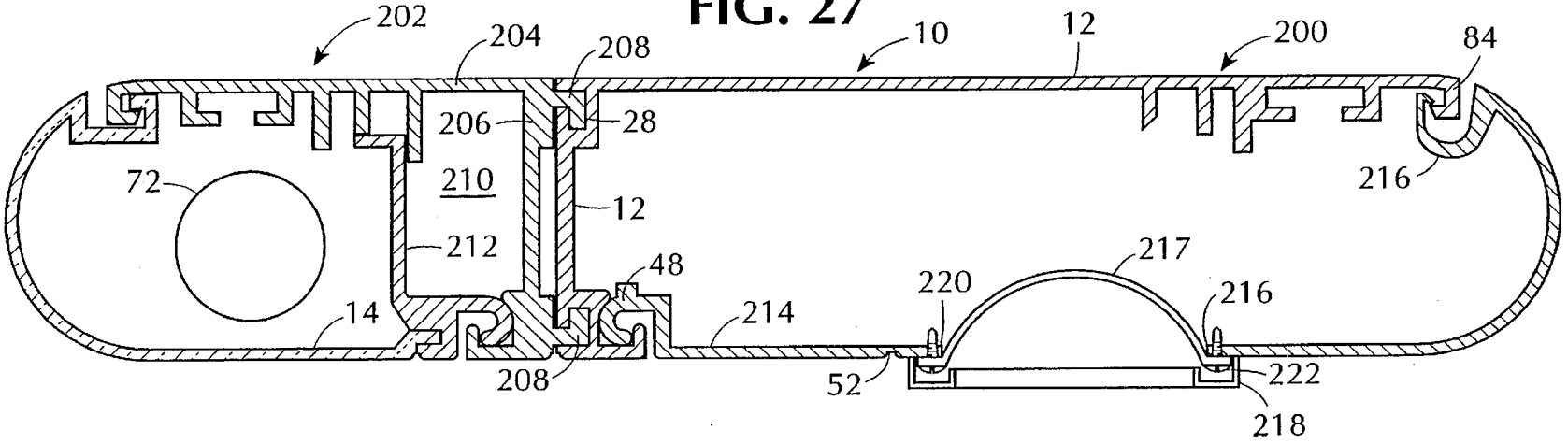
FIG. 27 is a sectional view similar to FIG. 2 showing another embodiment of the present invention.

Another embodiment of the invention is illustrated in FIG. 27, wherein a unit formed of two light sources or modules joined back to back is illustrated. The unit 200 illustrated in FIG. 28 consists of a light module 10, constructed as described above. Thus, corresponding reference numerals have been used for the L-shaped housing 12. A second module 202 is joined to the module 10, and is of similar construction. In this embodiment of the invention, the module 202 has an L-shaped housing 204 similar in construction to the housing 12 previously described, albeit with a shorter long leg length. In addition, its rear leg 206 has L-shaped extensions 208 formed thereon which are slidably received in the grooves 28 of housing 12. As a result of this construction housing 204 has a smaller wire way 210 and a smaller access panel 212. This module contains a fluorescent lamp 72 and a transparent cover 14 as previously described.

In this embodiment of the invention, module 10 does not have a transparent lens 14. Instead, its extruded aluminum cover plate 214 is a single unit having a hook-end portion 48 as previously described and an opposed snap end portion 216 for engagement in the hook-end 84 of housing 12. This extruded aluminum plate 214 provides for mounting of halogen bulbs therein.

Figure 28:
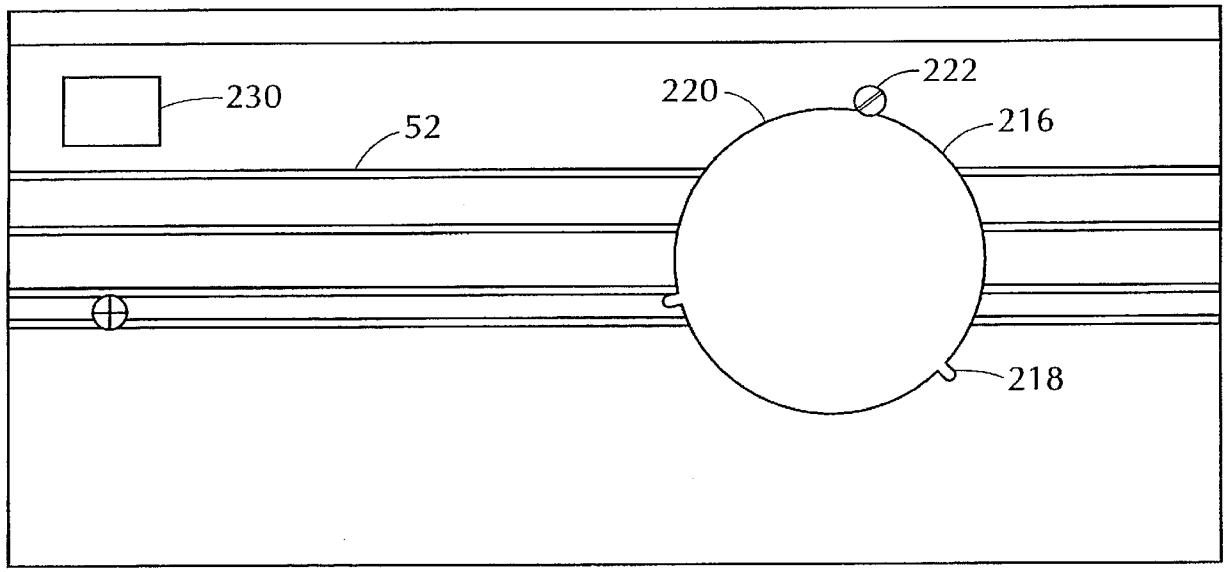
FIG. 28 is a partial plan view, from below, of a cover used for mounting halogen lamps in the module.

A portion of plate 214 is shown in plan view in FIG. 28. As seen there, plate 214 has decorative grooves 52 formed therein as previously described. In addition it has one or more mounting openings 216 formed therein. These mounting openings are adapted to receive circular halogen light fixtures such as sold under the trademark HATCH. These fixtures are of generally conventional construction and consist of a generally conical or parabolic reflector 217 in which a halogen bulb (not shown) is mounted. The reflector includes a flanged base 220 which is located on the outside of plate 214 with the parabolic reflector extending through opening 216. The reflector 216 is held in place by a plurality of self-tapping screws 222 threaded through flange 220 and cover 214. A removable trim ring 218 removably secured to flange 220, by a bayonet lock arrangement conceals the flange-and screws from view.

Plate 214 also includes an opening 230 formed therein for receiving a conventional on-off switch.

Preferably, the light units 10 are wired to have two alternate power supply circuits denominated "A" and "B". Supply circuit A will be connected to first conventional wall switch and circuit B to a second conventional wall switch. A selectivity switch 231 is provided in each unit 10, mounted on wall 56 in any convenient manner so the light fixture can be controlled by one or the other of the wall switches. The Switch 231 is of the type provided by S&K Components Inc. under the tradename L-Series Miniature Slide Switch. By this arrangement the units in a series can be selectively set so that only certain units are turned on by the wall switch connected to circuit A and the others by the wall switch connected to Circuit B. By varying the position of switch 231 in the unit, the user can vary the light patterns and position of light produced by a string of units under control of one of the wall switches. If desired, the halogen and fluorescent bulbs in a single housing may be separately connected to the "A" and "B" circuits. A schematic circuit diagram for such a switch is shown in FIG. 27.

In another embodiment of the invention, instead of the units 10 and 202 being removably joined together, as shown in FIG. 28, a single modular unit having two modules 10 positioned back to back can be provided which has a single housing 12 having a single intermediate wall 26 and two opposed legs 30.

By the construction of the present invention a modular light system is provided which is extremely safe to use and install. Once the first unit is electrically powered, the remaining units can be installed with the power on without danger to the installer. The units can then be installed in either direction completely safely. Moreover, the construction is such that any unit can be hard wired in place if desired, without disassembling the double insulated connectors.

In addition to hard wiring the light fixtures, as described above, if desired a wall plug arrangement can be provided. This wall plug would consist of a conventional power plug at one end and a female double insulated connector at the other for connection into the first module in a string. Where modules need to be spaced from one another, a cord set can be provided with male and female double insulated connectors at opposite ends in order to permit spacing of the serial modules.

Although various embodiments of the present invention have been described herein, it is to be understood that the invention is not limited to those precise embodiments, and the various changes and modifications may be affected therein by those skilled in the art without departing from the scope or spirit of this invention.

What is claimed is:

1. A light unit comprising a housing including an openable access panel, said housing having opposed ends, said opposed ends respectively having male and female double insulated electrical connector plug means therein for electrically connecting said unit to another light unit; said opposed ends of the housing each including end caps and said double insulated electrical connector plug means being removably mounted in said end caps; said end caps each having a peripheral rib extending outwardly from the cap and a recessed mounting panel, said mounting panel having at least one opening formed therein for receiving an associated plug means, said plug means extending from their associated panels a predetermined distance selected such that when a male and female plug means of adjacent light units are mated in electrical contact, the peripheral ribs of the units abut each other to form a gap-free joint therebetween.

2. A light unit as defined in claim 1 wherein said housing and end caps include cooperating means for snap fitting the end caps on the housing.

3. A light unit as defined in claim 2 wherein said cooperating means includes a guide channel formed in said housing and an elongated guide tongue on the end cap extending inwardly therefrom into said channel.

4. A light unit as defined in claim 3 wherein said end caps are formed of insulating material.

5. A light unit as defined in claim 4 wherein said plug means have fully isolated terminals.

6. A light unit as defined in claim 1 wherein said access panel is pivotally mounted on said housing.

7. A light unit as defined in claim 6 wherein said housing has at least one pair of internal longitudinally extending parallel spaced ribs, said panel being pivotally mounted to said housing along an axis parallel to said ribs, and at least one self tapping screw engaged with said panel and threaded between said ribs to releasably secure said access panel to the housing in a closed position thereby to define a wire way in the housing.

8. A light unit as defined in claim 7 including means for mounting and electric lamp in the housing outside of said wire-way.

9. A light unit as defined in claim 8 wherein said electric lamp is a halogen lamp.

10. A light unit as defined in claim 1 wherein said housing is formed of extruded aluminum.

11. A light unit as defined in claim 1 including end caps removably mounted on said opposed ends of said unit for selectively receiving said connector plugs.

12. A light unit as defined in claim 1 wherein at least one of said end caps has an opening formed therein which is at least partly circular in shape for selectively receiving one of said insulated electrical connection plug means and for selectively receiving a conventional power supply cord to supply electrical power to the interior of the unit.

13. A light unit as defined in claim 1 including means for mounting said unit to an overhead surface and allowing sliding of said unit relative to said surface.

14. A light unit as defined in claim 13 including at least two electric lamps mounted in the housing and switch means for selectively supplying power to either or both of said electric lamps.

15. A modular light unit comprising an elongated generally L-shaped in cross section housing, an elongated generally L-shaped in cross section access panel pivotally connected at the end of one of its legs to the end of one leg of the housing such that in a closed position the legs of the housing and panel are generally parallel to each other, the longer leg of the L-shaped housing being longer than the parallel leg of the access panel whereby a portion of the housing extends beyond the access panel, said housing and access panel together defining a wire-way for the unit and the portion of the housing extending beyond the panel defining an enclosure area for an electric lamp, said housing having opposed ends, said opposed ends respectively having male and female double insulated electrical connection plug means having fully isolated terminals for electrically connecting said unit to another light unit, and a removable cover for said electric lamp enclosure area.

16. A modular light unit as defined in claim 15 including means for mounting said electric lamp on said access panel.

17. A modular light unit as defined in claim 15 including means for mounting said electric lamp on said cover.

18. A modular light unit as defined in claim 17 wherein said electric lamp is a halogen lamp.

19. A light unit as defined in claim 15 wherein said opposed ends of the housing each include an end cap and said double insulated electrical connector plug means are removably mounted in said end caps.

20. A light unit as defined in claim 19 wherein said end caps each have a peripheral rib extending outwardly from the cap and a recessed mounting panel, said mounting panel having at least one opening formed therein for receiving an associated plug means, said plug means extending from their associated panels a predetermined distance selected such that when a male and female plug means of adjacent light units are mated in electrical contact, the peripheral ribs of the units abut each other to form a gap-free joint therebetween.

21. A light unit as defined in claim 20 wherein said housing and end caps include cooperating means for snap fitting the end caps on the housing.

22. A light unit as defined in claim 21 wherein said cooperating means includes a guide channel formed in said housing and an elongated guide tongue on the end cap extending inwardly therefrom into said channel.

23. A light unit as defined in claim 22 wherein said end caps are formed of insulating material.

24. A light unit as defined in claim 23 wherein said housing has at least one pair of internal longitudinally extending parallel spaced ribs, said panel being pivotally mounted to said housing along an axis parallel to said ribs, and at least one self tapping screw engaged with said panel and threaded between said ribs to releasably secure said access panel to the housing in a closed position thereby to define a wire way in the housing.

25. A light unit as defined in claim 24 wherein said housing is formed of extruded aluminum.

26. A light unit as defined in claim 24 including end caps mounted on said opposed ends of said unit for selectively receiving said connector plug means.

27. A light unit as defined in claim 24 wherein at least one of said end caps has an opening formed therein which is at least partly circular in shape for selectively receiving one of said insulated electrical connection plug means and for selectively receiving a conventional power supply cord to supply electrical power to the interior of the unit.

28. A light unit as defined in claim 15 including means for mounting said unit to an overhead surface by sliding said unit relative to said surface.

29. A light unit as defined in claim 15 including at least two electric lamps mounted in the housing and switch means for selectively supplying power to either or both of said electric lamps.

* * * * *

UNITED STATES PATENT AND TRADEMARK OFFICE

CERTIFICATE OF CORRECTION

PATENT NO. : 5,658,067
DATED : August 19, 1997
INVENTOR(S) : Joseph D. Engle et al.

It is certified that error appears in the above-identified patent and that said Letters Patent is hereby corrected as shown below:

Title page,
Item [73], Assignee, should read -- JJI Lighting Group, Inc., Greenwich, Ct. --

Signed and Sealed this

Fourteenth Day of June, 2005

JON W. DUDAS
*Director of the United States Patent and Trademark Office*